US011332337B2

(12) United States Patent
Beemer et al.

(10) Patent No.: US 11,332,337 B2
(45) Date of Patent: May 17, 2022

(54) FLEXIBLE BAILS ON PRINTERS

(71) Applicant: Hewlett-Packard Development Company, L.P., Spring, TX (US)

(72) Inventors: Darryl L. Beemer, Boise, ID (US); Daniel Scott Ellis, Boise, ID (US); Jeffrey C. Madsen, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/256,477

(22) PCT Filed: Nov. 2, 2018

(86) PCT No.: PCT/US2018/058902

§ 371 (c)(1),
(2) Date: Dec. 28, 2020

(87) PCT Pub. No.: WO2020/091802

PCT Pub. Date: May 7, 2020

(65) Prior Publication Data

US 2021/0245987 A1 Aug. 12, 2021

(51) Int. Cl.

| | |
|---|---|
| ***B65H 31/26*** | (2006.01) |
| ***B65H 29/50*** | (2006.01) |
| ***B65H 31/04*** | (2006.01) |
| ***B65H 43/02*** | (2006.01) |
| ***B65H 43/06*** | (2006.01) |

(52) U.S. Cl.

CPC ..... *B65H 31/26* (2013.01); *B65H 29/50* (2013.01); *B65H 31/04* (2013.01); *B65H 43/02* (2013.01); *B65H 43/06* (2013.01); *B65H 2301/4212* (2013.01); *B65H 2301/4219* (2013.01); *B65H 2511/13* (2013.01); *B65H 2511/152* (2013.01)

(58) Field of Classification Search

CPC ..... B65H 31/26; B65H 33/08; B65H 43/00; B65H 43/02; B65H 2301/4219; B65H 2511/11; B65H 2511/13; B65H 2511/15; B65H 2511/152

See application file for complete search history.

(56) References Cited

U.S. PATENT DOCUMENTS

| | | | | |
|---|---|---|---|---|
| 4,208,122 A | | 6/1980 | Iwamoto et al. | |
| 5,228,679 A | | 7/1993 | Borostyan | |
| 5,609,333 A | * | 3/1997 | Mandel | H04N 1/32561 270/58.11 |
| 5,823,529 A | | 10/1998 | Mandel et al. | |

(Continued)

FOREIGN PATENT DOCUMENTS

| | | | | |
|---|---|---|---|---|
| EP | 2784013 A2 | * | 10/2014 | B41J 11/0005 |
| JP | H11139665 | | 5/1999 | |

(Continued)

*Primary Examiner* — Prasad V Gokhale

(74) *Attorney, Agent, or Firm* — HP Inc. Patent Department

(57) ABSTRACT

In example implementations, a flexible bail of a printing device is provided. The flexible bail comprises a rigid bail coupled to a rotational motor, a flexible portion and a controller. The flexible portion is coupled to an end of the rigid bail. The flexible portion includes a plurality of segments that are unidirectionally flexible. The controller is communicatively coupled to the rotational motor to control movement of the rigid bail.

15 Claims, 4 Drawing Sheets

(56) References Cited

U.S. PATENT DOCUMENTS

| | | | | |
|---|---|---|---|---|
| 7,686,296 | B2 | 3/2010 | Kaneko et al. | |
| 8,625,129 | B2 | 1/2014 | Noy et al. | |
| 2014/0131940 | A1 | 5/2014 | Fukuda | |
| 2014/0291921 | A1 | 10/2014 | Kobayashi et al. | |
| 2018/0370259 | A1* | 12/2018 | Cantrell | B41J 13/20 |
| 2020/0339370 | A1* | 10/2020 | Kotani | B65H 29/22 |

FOREIGN PATENT DOCUMENTS

| | | |
|---|---|---|
| JP | 2016011206 | 1/2016 |
| WO | WO-2017180152 | 10/2017 |
| WO | WO-2018067144 | 4/2018 |

* cited by examiner

200

300

FLEXIBLE BAILS ON PRINTERS

BACKGROUND

Printing devices can be used to print text, images, and the like on print media. Users may submit print jobs electronically to the printing device. In some instances, the printing devices can handle large amounts of print jobs. The print jobs are queued in the printing device and printed on the print media one job at a time. The completed print jobs may be stacked in a finisher module until the print jobs are retrieved.

DETAILED DESCRIPTION

Examples described herein provide printers with flexible bails. As noted above, printers can stack completed print jobs in a stacker or bin of the printer. The printer may offset each print job such that the print jobs can be easily separated.

Current finishing modules for printers may have mechanisms that move from side to side. For example, a mechanism inside the finishing module may shift the completed print job inside of the finishing module before dispensing the completed print job. In another example, the stacker or bin itself can move to offset the completed print jobs.

However, the moving parts of the finishing module may cause the printer to have a large footprint to house the components associated with the moving parts. The present disclosure provides a flexible bail that can offset completed print jobs without lateral movement of components inside of the finishing module or the stacker or bin.

In one example, the flexible bail may have a rigid portion that can be rotated vertically and a flexible portion that may "catch" incoming print jobs that are completed. The flexible portion may be flexible in a single direction to remain rigid when not in contact with the print media in the stacker, but begin to flex as portions of the flexible portion contact the print media.

The movement of the rigid bail portion may be controlled by a processor of the printer. The movement may be controlled based on a stack height of completed print jobs, a size of a current print job, and a length of each segment of the flexible portion of the flexible bail.

Figure 1:
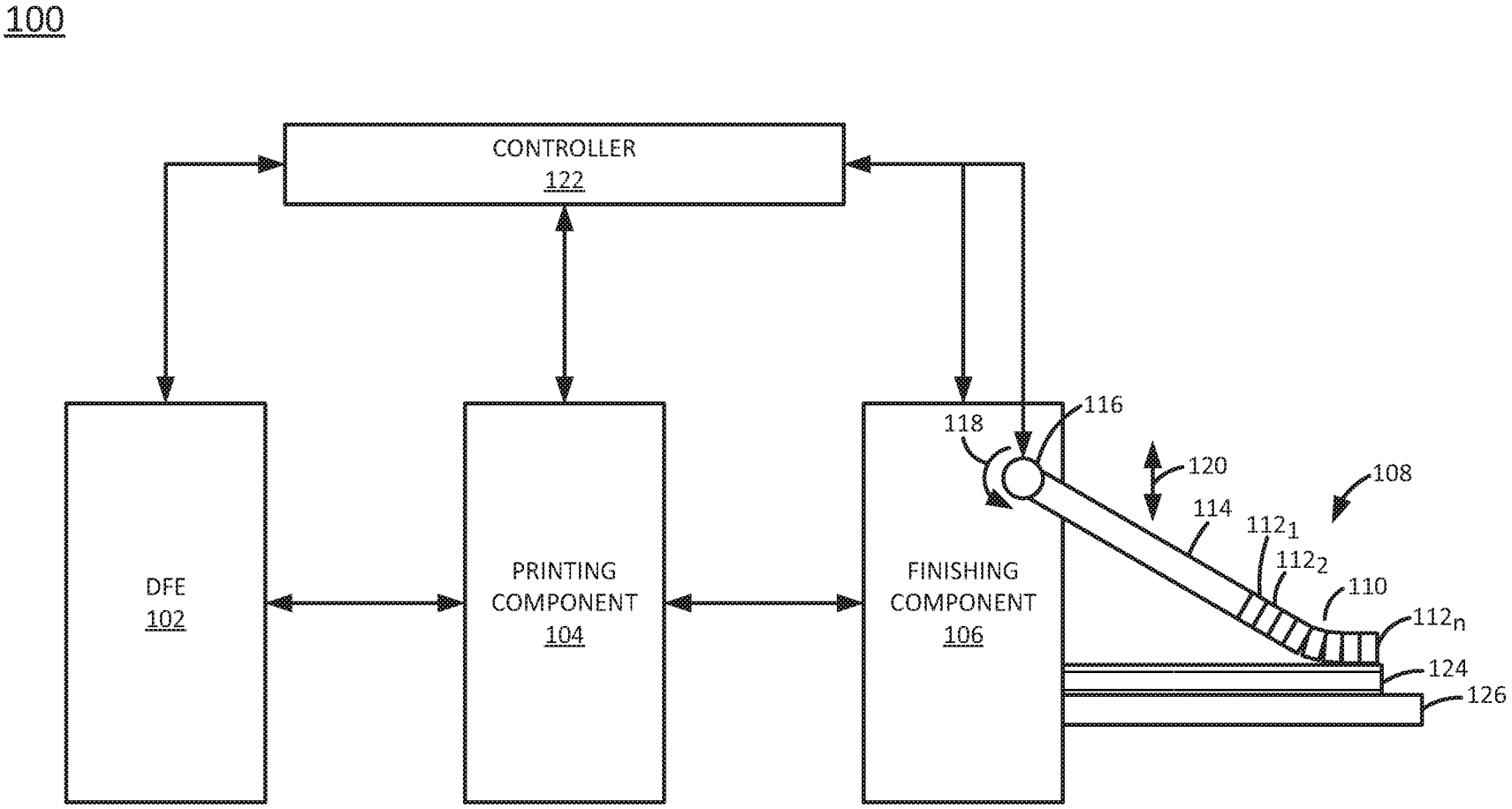
FIG. 1 is a block diagram of an example printer having a flexible bail of the present disclosure.

FIG. 1 illustrates an example apparatus 100. In one example, the apparatus 100 may be a printing device, a photo-copying device, a multi-function device, and the like. The apparatus 100 may be any type of imaging device that outputs print media 124. The print media 124 may be paper.

In one example, the apparatus 100 may include a digital front end (DFE) 102, a printing component 104, and a finishing component 106. The DFE 102 may process print job requests received from remotely located endpoint devices (not shown). For example, the DFE 102 may convert a print job into a page description language that provides a description, parameters, and the like associated with the print job request that is understood by the apparatus 100.

In one example, the printing component 104 may include a print path. For example, the printing component 104 may include a transport path, ink or toner, and other mechanical components that execute the print job. For example, the images, text, and the like described by the PDL and processed by the DFE 102 may be printed by the printing component 104.

In one example, the finishing component 106 may compile the completed print jobs. For example, the finishing component 106 may collate pages, staple pages together, and the like. The finishing component 106 may hold the print media 124 in a bin 126 for collection.

In one example, the finishing component 106 may also provide an offset between print jobs. As a result, multiple print jobs may be separated by an offset such that each print job can be easily retrieved and separated from other print jobs.

As noted above, current finishing modules may have mechanical parts to create the offset. For example, a tray in the bin 126 may move side to side. In another example, a roller or other mechanical portion inside the finishing module may move side to side before outputting the printed print media. Such mechanical moving parts may be relatively expensive and require more space in the MFD causing a larger footprint for the overall size of the device.

In one example, the finishing component 106 of the present disclosure may be simplified to include the bin 126 and a flexible bail 108. The print media 124 may continue to travel forward until the print media 124 is stopped by the flexible bail 108, as described below. In other words, the finishing component 106 (e.g., internal or external) may be simplified to remove features that can collate pages, stack pages, staple pages, and the like, and may instead deploy the bin 126 and the flexible bail 108.

The flexible bail 108 may include a rigid portion 114 and a flexible portion 110. The rigid portion 114 may be coupled to a motor 116. The motor 116 may be a rotational motor that has a rotational movement (as shown by an arrow 118). The rotational movement may cause the rigid portion 114 to move in a vertical direction up and down (e.g., closer to the print media 124 or further away from the print media 124) as shown by an arrow 120.

The rigid portion 114 may be fabricated from a metal or rigid plastic. The rigid portion 114 may maintain its shape against a nominal force applied against the rigid portion 114. For example, as the rigid portion 114 is raised, the rigid portion 114 may maintain its shape against gravitational force that is applied downward (e.g., towards the print media 124) on the rigid portion 114.

An end of the flexible portion 110 may be coupled to an end of the rigid portion 114 that is opposite an end that is coupled to the motor 118. The flexible portion 110 may include segments $\mathbf{112}_1$ to $\mathbf{112}_n$ (hereinafter also referred to individually as a segment 112 or collectively as segments 112). The segments 112 may be coupled to one another, or arranged end-to-end, such that the segments 112 are unidirectionally flexible. In other words, the flexible portion 110 may bend in one direction, but not in the opposite direction. Said another way, the flexible portion 110 may maintain a flat shape that is parallel to the rigid portion 114 against gravitational forces (e.g., a force applied towards the print media 124). However, when the print media 124 contacts the flexible portion 110 and applies a force upward (e.g., away from the print media 124), the flexible portion 110 may begin to bend, curve, or flex.

In one example, the segments 112 may be fabricated from a material that can "catch" the print media 124. For example, the segments 112 may be fabricated from a rubber or a plastic with a coating (e.g., a semi-adhesive coating, a latex coating, a rubber based coating, and the like). The segments 112 may be fabricated from the same material or some segments 112 may be fabricated from different materials.

In one example, the flexible portion 110 may be flexible or bend in a concave direction relative to the print media 124. In other words, the curve, or an apex of the curve, may contact the print media 124.

In one example, the apparatus may also include a controller 122. The controller 122 may be communicatively coupled to the DFE 102, the printing component 104, and the finishing component 106. The controller 122 may be a processor or central processing unit (CPU).

The controller 122 may control operation of the DFE 102, the printing component 104, and the finishing component 106. The controller 122 may coordinate movement of the print media 124 through the apparatus 100.

The controller 122 may also control movement of the motor 116 to move the rigid portion 114 up and down (as shown by the arrow 120). For example, as a height of the stack of print media 124 in the bin 126 rises, the controller 122 may activate the motor 116 to raise the rigid portion 114. Thus, the offset position may be adjusted. The amount that the motor 116 and the rigid portion 114 are moved may be a function of a height of the print media 124 stacked in the bin 126, a size (e.g., a thickness) associated with a current print job request, and a length of each segment 112. In one example, if the print media 124 is removed, the controller 122 may activate the motor 116 to cause the rigid portion 114 to be lowered to a starting position.

Figure 2:
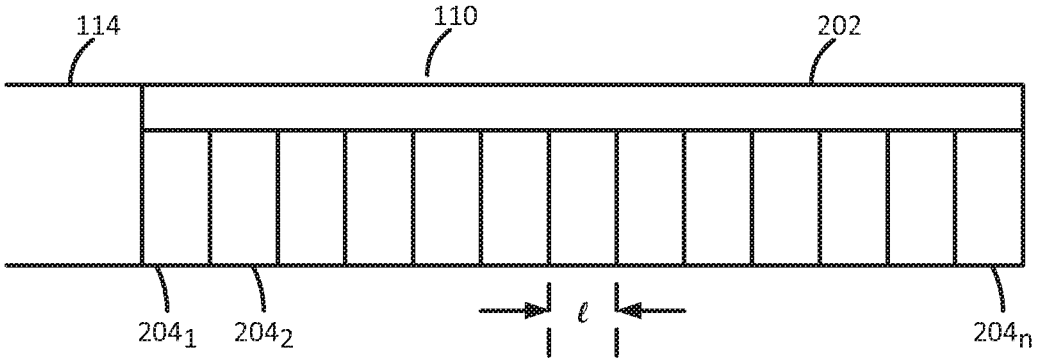
FIG. 2 is a side view of an example of a flexible bail of the present disclosure.
Figure 3:
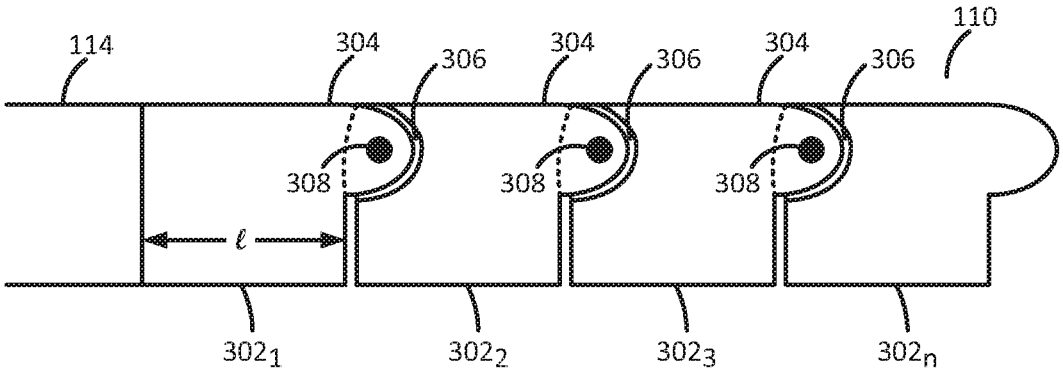
FIG. 3 is a side view of another example of a flexible bail of the present disclosure.

FIGS. 2 and 3 illustrate different examples of flexible bails. FIG. 2 illustrates a flexible bail 200 for a printing device (e.g., the apparatus 100). In one example, the flexible bail 200 may include a rigid portion or bail 114 that is coupled to the rotational motor 116, as described above.

In one example, the flexible bail 200 may include the flexible portion 110. The flexible portion may include a plurality of segments $\mathbf{204}_1$-$\mathbf{204}_n$ (hereinafter also referred to individually as a segment 204 or collectively as segments 204). The segments 204 may be coupled to a membrane 202 in an end-to-end fashion. The segments may be coupled to the membrane 202 via an adhesive, via a mechanical connection, and the like.

The membrane 202 may be flexible layer of material. For example, the membrane 202 may be a flexible plastic or a thin piece of metal that has some flexibility. The segments 204 may be arranged on the membrane such that the flexible portion 110 may be unidirectionally flexible. For example, the segments 204 may be arranged such that a force applied on a side of the membrane 202 may not cause the flexible portion 110 to curve or bend. However, a force applied on a side of the segments may cause the flexible portion 110 to curve upwards (e.g., in a direction away from the print media 124).

The segments 204 may be spaced adjacent to one another with no space or very little space between the segments. As such, the segments 204 may support one another when a force is applied to the side of the membrane 202 to prevent the flexible portion from bending downward (e.g., in a direction toward the print media 124). However, the segments 204 may move away from one another when a force is applied to a side of the segments 204 causing the flexible portion 110 to curve or bend upwards.

In one example, each segment 204 may have an equal length "l" as shown in FIG. 2. The amount of granularity in the amount of offset for the print media 124 on the bin may be a function of the length "l" of each segment 204. The smaller the length of each segment 204, the finer control of offset.

In one example, the segments 204 may have different lengths. For example, the length of the segments 204 may be largest on an end towards the rigid bail 114 and be the smallest on an opposite end away from the rigid bail 114. For example, the large lengths of the segments (e.g., segments $\mathbf{204}_1$ and $\mathbf{204}_2$) near the rigid bail 114 may provide more support for the flexible portion 110, while being unlikely to be used to perform the offset of the print media 124. The smaller lengths of the segments away from the rigid bail 114 (e.g., segment $\mathbf{204}_n$) may provide control of the offset amounts of the print media 124.

FIG. 3 illustrates a flexible bail 300 for a printing device (e.g., the apparatus 100). In one example, the flexible bail 300 may include a rigid portion or bail 114 that is coupled to the rotational motor 108, as described above.

In one example, the flexible bail 300 may include the flexible portion 110. The flexible portion may include a plurality of segments $\mathbf{302}_1$-$\mathbf{302}_n$ (hereinafter also referred to individually as a segment 302 or collectively as segments 302).

In one example, the segments 302 may be connected via a mechanical connection. The mechanical connection may include a cutout 306 and a rotating connector 304. Each segment 302 may have a cutout 306 on one end and a rotating connector 304 on an opposite end. Each side of each end may include a cutout 306 or a rotating connector 304. In other words, a first end of the segment 302 may include two cutouts 306 on opposite sides and a second end of the segment 302 may include two rotating connectors 304 on opposite sides.

In one example, the rotating connector 304 may have a curved end. The rotating connector 304 of a segment 302 may be coupled to a cutout 306 of an adjacent segment 302 via a pin 308 that connects adjacent segments 302. For example, the rotating connector 304 of the segment $\mathbf{302}_1$ may be connected to the cutout 306 of the segment $\mathbf{302}_2$, and so forth down to the segment $\mathbf{302}_n$.

In one example, the segments 302 may be arranged to be contacting one another or have a small amount of space between one another. The arrangement of the segments 302 along with the design of the rotating connector 304 and the cutout 306 may allow the flexible portion 110 to bend in a single direction.

For example, the arrangement of the segments 302 adjacent to one another may cause the side walls to support each other when a force is applied to a top side of the flexible portion 110. In other words, arranging the segments 302 to touch or contact one another may prevent the flexible portion 110 from bending or curving towards the print media 124. However, the arrangement of the segments 302 with the rotating connector 304 and the cutout 306 may allow the segments 302 to rotating away from one another when a force is applied to a bottom side of the flexible portion 110.

In other words, the end of the flexible portion 110 may move upwards to create a concave curve. An apex of the curve may contact print media 124 in the bin 126. The contact between the apex of the concave curve and the print media 124 may create a stopping point to offset print media 124 ejected for a subsequent print job.

In one example, the segments 302 may have the same length "l". In another example, the segments 302 may have different lengths. The lengths of the segments 302 may be varied for the same reason the segments 202 in FIG. 2 may be varied.

It should be noted that FIGS. 2 and 3 illustrate a few examples of different flexible bails 108. Other types of designs, connections, arrangements, and the like, of segments may be deployed to create unidirectionally flexible bail to provide an offset for print media in a finishing component of an MFD.

Figure 4:
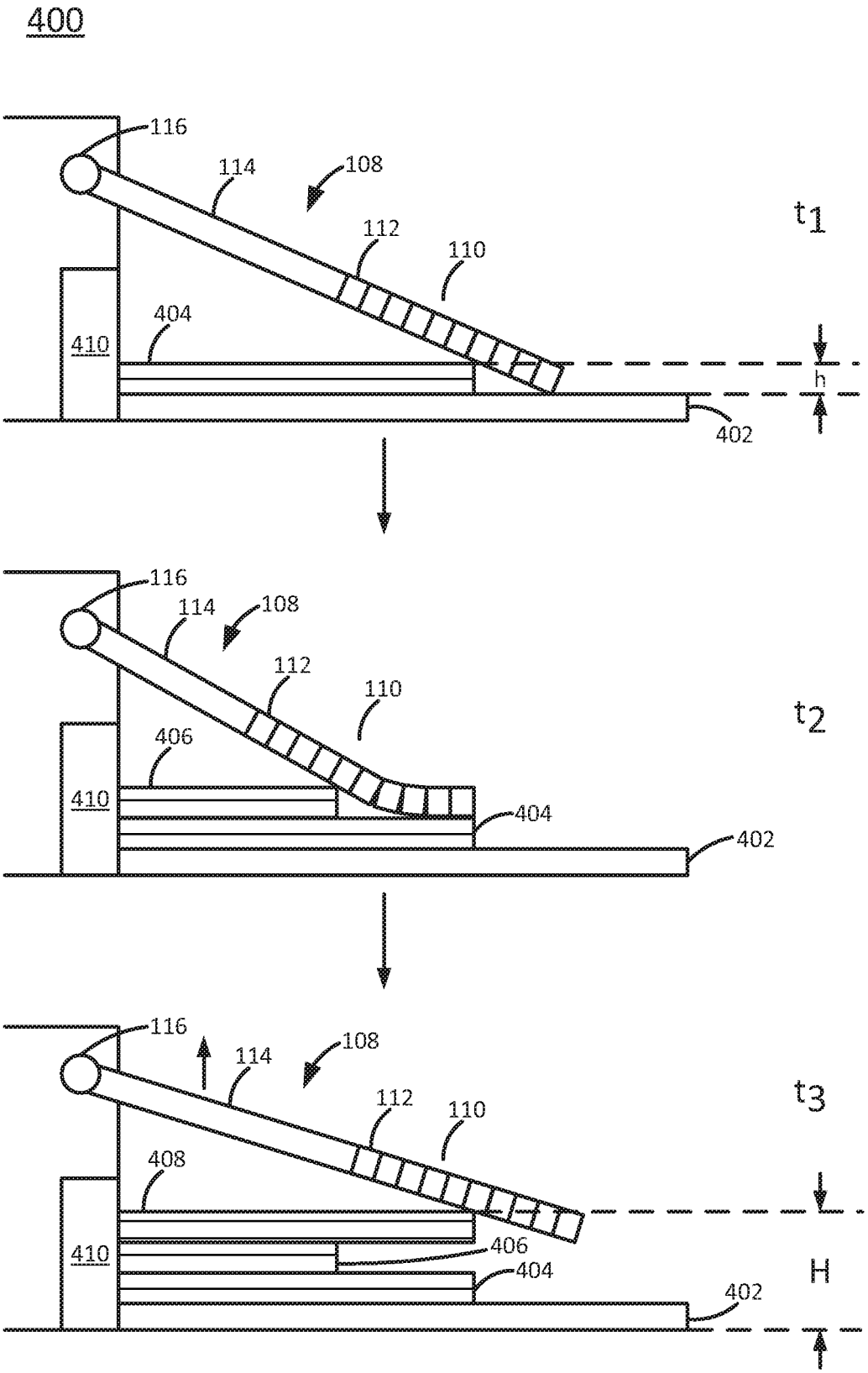
FIG. 4 is a schematic diagram of example movements of the flexible bail in a finishing module of a printer as print jobs are completed.

FIG. 4 illustrates a schematic diagram 400 of example movements of the flexible portion 110 of a flexible bail 108 in the finishing module 106 of an MFD as print jobs are completed. At time t1, the flexible bail 108 may be in a starting position, where, an end of the flexible bail 108 may be in contact with a surface of a bin 402.

A print job may include a first stack of print media 404. The first stack of print media 404 may have a thickness or a height of "h". In one example, the thickness of a stack or a height of a stack may refer to the same dimension.

In one example, the finishing component 106 may include a bin capacity sensor 410, as noted above. However, a longer flexible portion 110 can allow the finishing component 106 to function without the use of the bin capacity sensor 410. The bin capacity sensor 410 may detect a top of the first stack of print media 404.

At time t2, the rigid bail 114 may be moved downward, resulting in the flexible portion 110 contacting the first stack of print media 404 at a point closer to the finishing component 106 than a lead edge of the first stack of print media 404. The segments 112 that are not in contact with the first stack of print media 404 may remain "rigid" or parallel with the rigid bail 114. In other words, the segments 112 that are not in contact with the first stack of print media 404 may be straight or lie on a same plane as the rigid bail 114. The segments 112 that are not in contact with the first stack of print media 404 may be in a position to receive print media from a second print job and offset the print media from the first stack of print media 404.

A second print job may be completed and a second stack of print media 406 may stop against the segments 112 of the flexible portion 110 of the flexible bail 108 that are not in contact with the first stack of print media 404. As a result, the second stack of print media 406 may be offset from the first stack of print media 404.

The bin capacity sensor 410 may calculate an overall height "H" of the stacks 404 and 406 in the bin 402. Based on a current height of the stacks 404 and 406 in the bin 402, a size (e.g., a calculated thickness or height "h") of a current print job request, and a length of each segment 112 of the flexible portion 110, the controller 122 may determine that the motor 116 should be rotated and an amount the motor 116 should be rotated.

For example, the controller 122 may determine that the second stack of print media 406 may be contacting the last few segments 112 of the flexible portion 110. As a result, another stack of print media may contact the rigid bail 114 rather than the segments 112 of the flexible portion 110. In response, the controller 122 may activate the motor 116 to raise the rigid bail 114. The rigid bail 114 may then be moved upwards by the rotation of the motor 116 and the second stack of print media 406 may contact lower segments 112 (e.g., segments further away from the rigid bail 114) of the flexible portion 110. In other words, the controller 122 may calculate the amount of rotation of the motor 116 based on the factors noted above such that an end of the flexible portion 110 contacts a top most stack of print media (e.g., the second stack of print media 406) currently in the bin 402.

At time t3, the rigid bail 114 may be moved upward, and a third print job may be completed and a third stack of print media 408 may be ejected into the bin 402. The third stack of print media 408 may contact the flexible portion 110 and be offset from the second stack of the print media 406. In one example, when the rigid bail 114 is moved, the movement may "reset" the offset position. For example, the position of the third stack of print media 408 may be the same as the first stack of print media 404. The third stack of print media 408 may cause the flexible portion 110 of the flexible bail 108 to curve upwards to create a concave curve. As a result, a subsequent stack of print media from a fourth print job may be offset from the third stack of print media 408, and so forth. Thus, the present disclosure provides a flexible bail that can simplify components of an MFD to reduce overall costs and size of the MFD.

Figure 5:
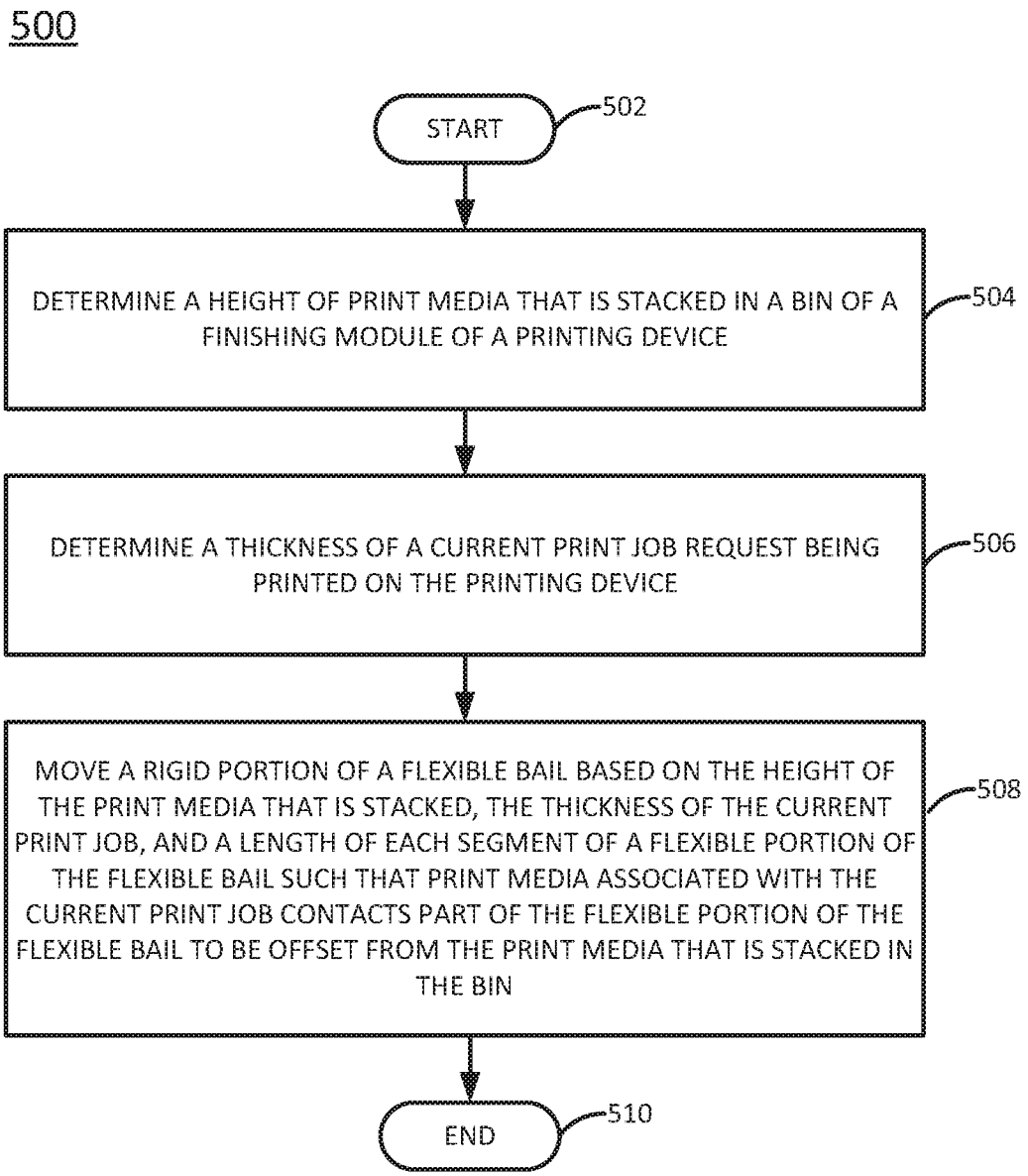
FIG. 5 is a flow chart of an example method for offsetting print jobs in a printer using a flexible bail.

FIG. 5 illustrates a flow diagram of an example method 500 for moving a bail of a multi-function device. In an example, the method 500 may be performed by the apparatus 100 described above. For example, the method 500 may be stored in memory of the apparatus 100 and executed by a processor (e.g., the controller 122).

At block 502, the method 500 begins. At block 504, the method 500 determines a height of print media that is stacked in a bin of a finishing module of a printing device. For example, a finishing module of the MFD may include a bin to hold the print media that is outputted by the MFD. The bin may include a sensor that can detect whether any print media is stacked inside of the bin and determine a height of the stack.

At block 506, the method 500 determines a thickness of a current print job request being printed on the printing device. For example, the processor may obtain information associated with a print job. The controller may obtain information by communicating with the digital front end that processes the print job request and translates the print job into a printing language or protocol to be executed by the MFD. The thickness may be calculated based on a known thickness of a selected print media and a number of pages in the print job.

At block 508, the method 500 moves a rigid portion of a flexible bail based on the height of the print media that is stacked, the thickness of the current print job, and a length of each segment of a flexible portion of the flexible bail such that print media associated with the current print job contacts part of the flexible portion of the flexible bail to be offset from the print media that is stacked in the bin. In one example, the flexible bail may be moved downward during a current print job such that the flexible portion may contact the print media 404 at a point closer to the finishing component than a lead edge of the stack of the print media.

After the print job is completed, the flexible bail may be moved upward to prepare for a subsequent print job. For example, based on the height of the print media that is stacked in the bin and a thickness of the current print job, a motor connected to the rigid portion may rotate to move the rigid portion higher (e.g., away from the print media stacked in the bin). Thus, the flexible bail may also rise. As the flexible bail rises, segments that were contacting the print media stacked in the bin may no longer contact the print media. Thus, the stopping point for the print media may be moved out further away from the output path of the finishing component of the MFD.

The blocks 504, 506, and 508 may be repeated for each print job that is processed by the MFD. In some examples, the rigid portion may stay in position until print media contacts a pre-defined portion of the flexible bail. When the pre-defined portion of the flexible bail contacts the print media, the print media may be too close to the output path of the finishing component. In other words, the print media can no longer be offset. In response, the rigid portion may be raised to allow the print media to be outputted further away from the output path and the print media can be offset again.

In one example, when the paper is removed the bin sensor may detect that the bin is empty. When the bin is detected to be empty, the controller of the MFD may move the motor connected to the rigid portion of the bail back to a starting position. At block 510, the method 500 ends.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A flexible bail of a printing device, comprising:
- a rigid bail coupled to a rotational motor;
- a flexible portion coupled to an end of the rigid bail, wherein the flexible portion comprises a plurality of segments that are unidirectionally flexible; and
- a controller communicatively coupled to the rotational motor to control movement of the rigid bail.

2. The flexible bail of claim 1, wherein the rotational motor moves the rigid bail in a vertical direction.

3. The flexible bail of claim 1, wherein the flexible portion is unidirectionally flexible in a concave direction towards a print media in a bin.

4. The flexible bail of claim 1, wherein the flexible portion comprises:
- a flexible membrane coupled to the plurality of segments, wherein the plurality of segments are aligned end-to-end on the flexible membrane.

5. The flexible bail of claim 1, wherein each one of the plurality of segments comprises a cutout to receive a mechanical rotating connector of an adjacent segment on a first end and a respective mechanical rotating connector on a second end.

6. The flexible bail of claim 1, wherein each one of the plurality of segments have a same length.

7. The flexible bail of claim 1, wherein each one of the plurality of segments have a different length.

8. A printing device, comprising:
- a digital front end to process a print job request;
- a printing component to print the print job request onto print media; and
- a finishing component to stack the print media associated with the print job request that is completed in a bin, wherein the finish component comprises a flexible bail, wherein the flexible bail comprises:
  - a rigid bail coupled to a rotational motor;
  - a flexible portion coupled to an end of the rigid bail, wherein the flexible portion comprises a plurality of segments that are unidirectionally flexible; and
  - a controller communicatively coupled to the rotational motor to control movement of the rigid bail.

9. The printing device of claim 8, wherein a portion of the flexible portion that is in contact with the print media bends in a concave direction.

10. The printing device of claim 8, wherein a portion of the flexible portion that is not in contact with the print media remains rigid in parallel with the rigid bail.

11. The printing device of claim 8, further comprising:
- a bin capacity sensor coupled to the bin to detect a height of the print media in the bin.

12. The printing device of claim 11, wherein the controller moves the rotational motor to raise the rigid bail in a vertical direction based on the height of the print media in the bin, a size of the print job request, and a length of each segment of the plurality of segments.

13. A method, comprising:
- determining a height of print media that is stacked in a bin of a finishing module of a printing device;
- determining a thickness of a current print job request being printed on the printing device; and
- moving a rigid portion of a flexible bail based on the height of the print media that is stacked, the thickness of the current print job, and a length of each segment of a flexible portion of the flexible bail such that print media associated with the current print job contacts part of the flexible portion of the flexible bail to be offset from the print media that is stacked in the bin.

14. The method of claim 13, further comprising:
- detecting that the bin is empty; and
- returning the rigid portion of the flexible bail to a starting position.

15. The method of claim 13, wherein the thickness of the current print job is calculated based on a number of pages in the print job and a thickness of the print media associated with the current print job.

* * * * *